US009606477B2

(12) United States Patent
Yagi et al.

(10) Patent No.: US 9,606,477 B2
(45) Date of Patent: Mar. 28, 2017

(54) IMAGE FORMING APPARATUS

(71) Applicant: CANON KABUSHIKI KAISHA, Tokyo (JP)

(72) Inventors: Yasutaka Yagi, Mishima (JP); Kazuhiro Funatani, Mishima (JP); Tetsuichiro Fujimoto, Mishima (JP); Hiroyuki Seki, Suntou-gun (JP); Masanori Asai, Tokyo (JP); Shuji Saito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,742

(22) Filed: Mar. 22, 2016

(65) Prior Publication Data

US 2016/0282767 A1 Sep. 29, 2016

(30) Foreign Application Priority Data

Mar. 25, 2015 (JP) ..... 2015-062573

(51) Int. Cl.
*G03G 15/08* (2006.01)
*G03G 15/16* (2006.01)
*G03G 21/00* (2006.01)

(52) U.S. Cl.
CPC ..... *G03G 15/161* (2013.01); *G03G 21/0011* (2013.01); *G03G 2215/0132* (2013.01); *G03G 2221/001* (2013.01); *G03G 2221/0073* (2013.01)

(58) Field of Classification Search
CPC ..... G03G 15/161; G03G 2221/001; G03G 2221/1642; G03G 2221/0073
USPC ..... 399/101, 121
See application file for complete search history.

(56) References Cited

U.S. PATENT DOCUMENTS 7,978,998 B2 * 7/2011 Nakagawa ..... G03G 21/0047 399/101
8,290,384 B2 * 10/2012 Hyakutake ..... G03G 15/1605 399/101
2006/0245782 A1 * 11/2006 Hirai ..... G03G 15/168 399/101

FOREIGN PATENT DOCUMENTS

JP 2009139442 A 6/2009
JP 2014119464 A 6/2014

* cited by examiner

*Primary Examiner* — Hoang Ngo
(74) *Attorney, Agent, or Firm* — Canon U.S.A. Inc., IP Division

(57) ABSTRACT

An image forming apparatus including a cleaning member having a belt cleaning blade and a conductive brush. A value of a charging current that is generated when charging residual toner with the conductive brush is smaller when a color mode is executed compared to that when a monochrome mode is executed.

11 Claims, 3 Drawing Sheets

IMAGE FORMING APPARATUS

BACKGROUND OF THE INVENTION

Field of the Invention

The present disclosure relates to image forming apparatuses, such as a copier, a printer, a facsimile machine, and a multifunctional printer that form images employing an electrophotographic method.

Description of the Related Art

In recent years, colorization in image forming apparatuses, such as a printer and a copier, is in progress. For example, as an image forming apparatus employing an electrophotographic method, the following image forming apparatus employing an intermediate transfer system and an in-line system is well known. That is, in the above image forming apparatus, a plurality of image forming units that each include an electrophotographic photoconductor (a photosensitive member) is disposed in a line on the surface of an intermediate transfer body in a moving direction of the intermediate transfer body. Furthermore, toner images with different colors formed on the photosensitive members of the image forming units are sequentially superposed on and transferred (primarily transferred) to the intermediate transfer body. Subsequently, the multiply superimposed toner images on the intermediate transfer body are transferred (secondarily transferred) together onto a transfer material.

In the image forming apparatus employing the intermediate transfer system, residual toner (residual secondary transfer toner) is generated on the intermediate transfer body after the toner image is secondarily transferred from the intermediate transfer body to the transfer material. Accordingly, a removing process of the residual secondary transfer toner is performed so that residual secondary transfer toner does not hinder formation of the next image on the intermediate transfer body.

As an intermediate transfer body cleaning member that removes the residual secondary transfer toner, a configuration in which residual secondary transfer toner on the intermediate transfer body is scraped off by providing a cleaning blade, which is a tabular member formed of an elastic body, in an intermediate transfer body cleaning device is well known. While a low-cost and satisfactory cleaning performance can be expected from the cleaning method, the method is susceptible to unevenness of the surface of the intermediate transfer body, and there are cases in which a satisfactory cleaning performance cannot be maintained owing to the residual secondary transfer toner passing through the cleaning blade around the uneven portion.

Furthermore, one with the following configuration described in Japanese Patent Laid-Open No. 2009-139442 is well known. That is, an intermediate transfer body cleaning device is configured to include a toner charging device that charges the residual secondary transfer toner on the intermediate transfer body to a polarity that is opposite the normal charging polarity of the toner. In such a configuration, the residual secondary transfer toner that has been charged to a polarity that is opposite the normal charging polarity of the toner is reverse transferred to the photosensitive member from the intermediate transfer body at a portion immediately after the primary transfer portion of the image forming unit. The residual secondary transfer toner that has been reverse transferred is collected by a photosensitive member cleaning device that cleans the photosensitive member. In other words, it is possible to clean the intermediate transfer body by reverse transferring the residual secondary transfer toner from the intermediate transfer body to the photosensitive member, at the same time as the toner image is primarily transferred from the photosensitive member to the intermediate transfer body. Hereinafter, the above is referred to as collection at transfer. When the residual secondary transfer toner is charged to a polarity that is opposite the normal charging polarity of the toner with the charging device, the value of the generated charging current needs to be controlled to an optimum value, and the optimum value of the charging current is determined in view of faulty cleaning and negative ghost.

Description of faulty cleaning will be given first. When the absolute value of the triboelectricity (the charge amount per unit weight of the toner) of the toner is lower than a desired value when the toner is being collected by the photosensitive member, there are cases in which faulty cleaning occurs in the next image that is being formed when continuous image formation is performed.

In other words, the cleaning of the intermediate transfer body by collection at transfer is performed with the photosensitive member and through the electric field between the photosensitive member and the intermediate transfer belt by collecting the residual secondary transfer toner that has been charged to have a positive polarity that is a polarity opposite to the normal charging polarity (a negative polarity) of the toner. Accordingly, toner with a weak positive polarity (in other words, toner with a small absolute value) or toner with a triboelectricity having a negative polarity is not collected by the photosensitive member at the primary transfer portion and the toner that has not been collected by the photosensitive member unfavorably remains in the image that is in formation. Accordingly, there are cases in which the residual secondary transfer toner of the previous image creates an image defect in the image that is in formation. In order to prevent such a phenomenon, a charging current that enables the triboelectricity of the toner being collected by the photosensitive member to have a positive polarity and a suitable value needs to be distributed to the charging device.

A description of the negative ghost will be given next. When the absolute value of the triboelectricity of the toner when the toner is being collected by the photosensitive member is higher than a desired value, when continuous image formation is performed, there are cases in which negative ghost occurs in the next image that is being formed.

The toner that has been charged to have a positive polarity with the charging device and that has a high triboelectricity (in other words, toner with a large absolute value), unfavorably, electrostatically absorbs the toner (negative polarity) of the next image formed on the photosensitive member when being collected by the photosensitive member at the primary transfer portion. Furthermore, the absorbed toner of the next image unfavorably returns to the photosensitive member without being primarily transferred to the intermediate transfer body. As a result, since the toner at a portion corresponding to the previous image is unfavorably returned to the photosensitive member, a difference in density is created in the image that is being formed. With the above, there are cases in which a negative ghost that has a thin density is observed in the portion on the image that is being formed corresponding to where the residual secondary transfer toner of the previous image exists. Particularly, a negative ghost tends to occur when the charge polarity of the residual secondary transfer toner is a positive polarity and when the tirboelectricity is high (in other word when the absolute value is large). In order to prevent such a phenomenon, a charging current that enables the triboelectricity of the toner being collected by the photosensitive member to have a positive polarity and a suitable value needs to be distributed to the charging device.

As described above, with the collection at transfer method, if the charging current distributed to the charging device is large, the negative ghost worsens and when small, faulty cleaning, on the other hand, worsens; accordingly a charging current that prevents both need to be set.

As regards another cleaning member, there is a so-called hybrid cleaning method described in Japanese Patent Laid-Open No. 2014-119464 in which a cleaning blade is provided upstream and a charging device is provided downstream. In the above method, since most of the residual secondary transfer toner is mechanically scraped off with the cleaning blade on the upstream side, the amount of toner (passed-through toner) that is supplied to the charging device on the downstream side is small. Accordingly, compared with the cleaning device configured with only the charging device, the amount of toner adhering to the charging device is smaller and there is an advantage in that the time needed to clean the charging device, a so-called downtime, can be reduced.

However, it has been found that in the hybrid cleaning method described above, when the lifetime of the device is increased, a new problem described below is met.

When the lifetime of the device is increased, the time in which the charging device charges the passed-through toner increases accordingly. As a result, due to deterioration in the current carrying capacity of the charging device, an increase in resistance occurs making it difficult for the charging current needed to charge the passed-though toner of flow; accordingly, there are cases in which faulty cleaning occur.

SUMMARY OF THE INVENTION

Accordingly, the present invention suppresses deterioration of the current carrying capacity of the charging member while suppressing faulty cleaning from occurring during image formation using the hybrid cleaning method.

In order to achieve the above, an image forming apparatus includes a plurality of image carrying members that each carry a toner image, an intermediate transfer body that is capable of moving while abutting against the image carrying members, the toner image of each image carrying member being primarily transferred onto the intermediate transfer body, a cleaning member that includes an abutting member that scrapes off residual toner that remains on the intermediate transfer body without being secondary transferred to a transfer material from the intermediate transfer body, and a charging member that is positioned downstream of the abutting member in a moving direction of the intermediate transfer body and that charges the residual toner that has passed through the abutting member, and a control unit that is capable of executing a first mode in which a toner image is primary transferred from each of the plurality of image carrying members to the intermediate transfer body, and a second mode in which a toner image is primary transferred from a single image carrying member among the plurality of image carrying members to the intermediate transfer body, in which the control unit controls a value of a charging current that is generated when charging the residual toner with the charging member such that the value when the first mode is executed is smaller than the value when the second mode is executed.

Further features of the present invention will become apparent from the following description of exemplary embodiments with reference to the attached drawings.

DESCRIPTION OF THE EMBODIMENTS

Hereinafter, a preferred exemplary embodiment of the present disclosure will be exemplified in detail with reference to the drawings. Note that the dimensions, the materials, and the shapes of the components and the relative configuration of the components, and the like that are described in the following exemplary embodiment are to be appropriately changed based on the device, to which the present disclosure is applied, and various conditions. Accordingly, unless otherwise specified in particular, the scope of the present disclosure is not intended to be limited by the exemplary embodiment described below.

First Exemplary Embodiment

(1) Overall Configuration of Image Forming Apparatus

Figure 1:
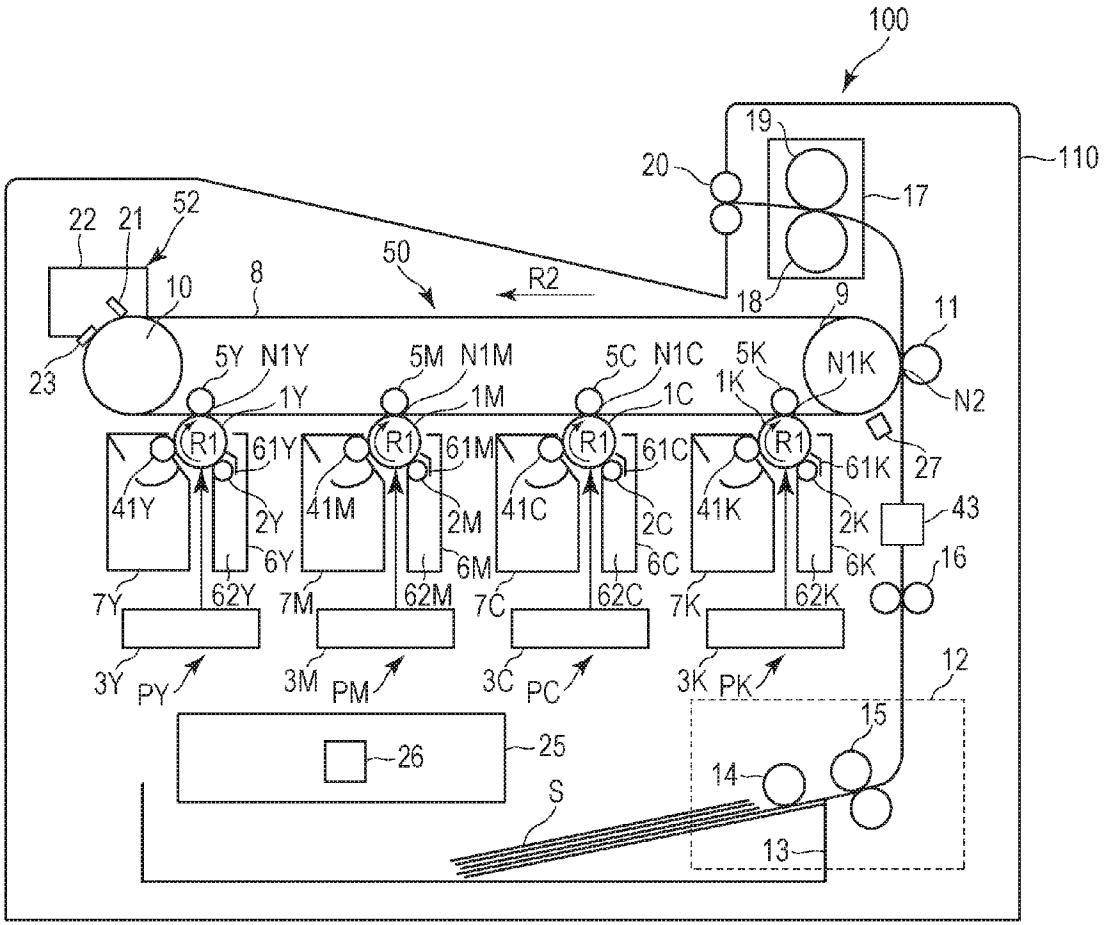
FIG. 1 is a schematic cross-sectional view of an image forming apparatus according to an exemplary embodiment of the present disclosure.

FIG. 1 illustrates a schematic configuration of an exemplary embodiment of an image forming apparatus according to the present disclosure. An image forming apparatus 100 of the present exemplary embodiment is an electrophotographic type full color printer employing an intermediate transfer system and an in-line system.

As a plurality of image forming unit, the image forming apparatus 100 includes four image forming units, namely, first, second, third, and fourth image forming units PY, PM, PC, and PK that form color images of yellow, magenta, cyan, and black, respectively. The four image forming units PY to PK are disposed in a line with uniform gaps therebetween.

Note that, in the present exemplary embodiment, other than the color of the toner used, the image forming units PY to PK have a lot in common in their configurations and operations. Accordingly, in the following description, when there is no particular need of distinction, the subscripts Y, M, C, and K, which are added to the reference numerals in the drawings to indicate the elements are provided for either one of the colors, will be omitted and will be described in a comprehensive manner.

The image forming unit P includes a cylindrical photosensitive member, that is, a photosensitive drum 1, serving as an image carrying member. A charge roller 2 serving as a charging device, a developing device 7 serving as a developing member, a primary transfer roller 5 serving as a primary transfer member, and a drum cleaning device 6 serving as a photosensitive member cleaning member are provided in the vicinity of the photosensitive drum 1. Furthermore, in the drawing, below a portion between the charge roller 2 and the developing device 7, an exposure device 3 serving as an exposure unit is provided. Furthermore, an intermediate transfer belt 8 that is an endless belt-shaped rotary member serving as an intermediate transfer body is disposed so as to oppose the photosensitive drums 1 of all of the image forming units P.

Yellow, magenta, cyan, and black toners are contained in the toner developing devices 7Y, 7M, 7C, and 7K, respectively. In the present exemplary embodiment, a toner that has a particle diameter of 6 μm and in which the normal charging polarity is a negative polarity is used in each of the colors.

In the present exemplary embodiment, the photosensitive drum 1 is an organic photosensitive member having a negative chargeability. The photosensitive drum 1 includes a photosensitive layer on an aluminum drum-shaped base and is rotationally driven at a predetermined processing speed in an arrow R1 direction (clockwise) in the drawing with a diving device (not shown). In the present exemplary embodiment, the processing speed is the circumferential velocity (surface moving speed) of the photosensitive drum 1.

The charge roller 2 is in contact with the photosensitive drum 1 at a predetermined contact pressure, and is applied thereto with a desirable charge voltage with a high-voltage power source for charging (not shown) so that the surface of the photosensitive drum 1 is uniformly charged at a predetermined potential. In the present exemplary embodiment, the photosensitive drum 1 is charged to have a negative polarity with the charge roller 2.

In the present exemplary embodiment, the exposure device 3 is a laser scanner device and outputs a laser beam corresponding to image information so as to scan and expose the surface of the photosensitive drum 1. With the above, an electrostatic latent image (an electrostatic image) corresponding to the image information is formed on the surface of the photosensitive drum 1.

In the present exemplary embodiment, the developing device 7 employs a contact developing method as the developing method. The developing device 7 includes a developing roller 41 serving as a toner carrying member. The electrostatic latent image formed on the photosensitive drum 1 is developed as a toner image with toner transported by the developing roller 41 at an opposing portion (a developing portion) between the developing roller 41 and the photosensitive drum 1. At this time, a development voltage is applied to the developing roller 41 with a high-voltage power source for developing (not shown). In the present exemplary embodiment, the electrostatic latent image is developed with a reversal developing method. In other words, the electrostatic latent image is developed into a toner image by adhering toner that has been charged to the same polarity as the charge polarity of the photosensitive drum 1 to portions on the photosensitive drum 1 after the charge process where the electric charge has become attenuated by the exposure.

In a full-color mode described later, the developing roller 41 of the developing device 7 of each image forming unit P abuts against the corresponding photosensitive drum 1. On the other hand, in a monochrome mode described later, in the image forming units other than the image forming unit that forms the image, the developing rollers 41 of the developing devices 7 are set apart from the corresponding photosensitive drums 1. Such a configuration is effective in preventing deterioration and exhaustion of the developing rollers 41 and the toner.

A single layer of resin such as polyethylene naphthalate (PEN), vinylidene fluoride resin (PVdF), ethylene-tetrafluoroethylene copolymer resin (ETFE), polyimide, polyethylene telephthalate (PET), or polycarbonate that has been formed into an endless belt shape and in which the volume resistivity has been adjusted to about $1\times10^{10}$ Ω·cm may be suitably used as the intermediate transfer belt 8 serving as the intermediate transfer body. Alternatively, a multi-layered configuration, in which a coat layer such as acryl is formed on a surface of a base layer, formed into an endless belt shape may be suitably used.

The intermediate transfer belt 8 is stretched across a driving roller 9 and a tension roller 10 serving as a plurality of support members and, upon transmission of rotational driving force to the driving roller 9, is capable of moving in an arrow R2 direction (anticlockwise) in the drawing. In the present exemplary embodiment, the intermediate transfer belt 8 is rotationally driven at a predetermined processing speed that is substantially the same as the circumferential velocity of the photosensitive drum 1. The primary transfer roller 5 is provided on the inner peripheral surface side of the intermediate transfer belt 8 so as to oppose the photosensitive drum 1 of the image forming unit P.

An elastic member such as a sponge rubber formed of polyurethane rubber, ethylene-propylene-diene (EPDM), nitrile butadiene rubber (NBR), or the like may be suitably used as the primary transfer roller 5. The primary transfer roller 5 presses the intermediate transfer belt 8 towards the photosensitive drum 1 to form a primary transfer portion (a primary transfer nip) N1 where the photosensitive drum 1 and the intermediate transfer belt 8 come in pressure contact with each other. In other words, the primary transfer roller 5 abuts against the photosensitive drum 1 at the primary transfer portion N1 with the intermediate transfer belt 8 in between. Subsequently, the primary transfer roller 5 following the intermediate transfer belt 8 is driven.

A high-voltage power source for transferring (not shown) is connected to the primary transfer roller 5. Furthermore, a predetermined voltage is applied to the primary transfer roller 5 from the high-voltage power source for transferring (not shown) at a predetermined timing. The toner image formed on the photosensitive drum 1 is transferred (primarily transferred) onto the rotating intermediate transfer belt 8 with the primary transfer roller 5 to which a predetermined transfer voltage has been applied with the high-voltage power source for transferring (not shown).

A secondary transfer roller 11 is in pressure contact with the intermediate transfer belt 8 at a position where the secondary transfer roller 11 opposes the driving roller 9 such that a secondary transfer portion (a secondary transfer nip) N2 is formed. In other words, the secondary transfer roller 11 abuts against the driving roller 9 with the intermediate transfer belt 8 in between.

A high-voltage power source for secondary transfer (not shown) is connected to the secondary transfer roller 11. Furthermore, a predetermined voltage is applied to the secondary transfer roller 11 from the high-voltage power source for secondary transfer at a predetermined timing. The toner image formed on the intermediate transfer belt 8 is transferred (secondary transferred) onto a transfer material S passing through the secondary transfer portion N2 with the secondary transfer roller 11 to which a predetermined secondary transfer voltage has been applied with the secondary transfer high-voltage power source.

A belt cleaning device 52 that serves as a cleaning member of the intermediate transfer body and that removes and collects residual transfer toner remaining on the surface of the intermediate transfer belt 8 is provided in the vicinity of the driving roller 9 on the outer peripheral surface side of the intermediate transfer belt 8. Details of the configuration and operation of the belt cleaning device 52 will be described later.

Note that in the present exemplary embodiment, the photosensitive drum 1, the driving roller 9, and the tension roller 10 are electrically grounded.

A registration roller 16 that synchronizes the transfer material S supplied from a transfer material storage portion 13 and the image on the intermediate transfer belt 8 to each other is disposed on the upstream side of the secondary transfer portion N2 in a transport direction of the transfer material S.

Furthermore, a fixing device 17 serving as a fixing member is provided on the downstream side of the secondary transfer portion N2 in the transport direction of the transfer material S. The fixing device 17 includes a fixing roller 18 built in with a heating member, and a pressure roller 19 that comes in pressure contact with the fixing roller 18. Furthermore, the fixing device 17 fuses the toner image onto the surface of the transfer material S by pinching and transporting the transfer material S, which is carrying unfixed toner, with the fixing roller 18 and the pressure roller 19.

The drum cleaning device 6 removes and collects the toner (residual primary transfer toner) remaining on the surface of the photosensitive drum 1 after the primary transfer. In other words, in the present exemplary embodiment, the drum cleaning device 6 includes an elastic blade 61 that is a tabular member formed of an elastic body serving as a cleaning member, and a collected toner container 62. Furthermore, the toner that has been removed from the surface of the photosensitive drum 1 with the elastic blade 61 is collected in the collected toner container 62.

Note that in each of the image forming units, the photosensitive member and at least one of a primary charging device, the developing member, and the cleaning member serving as processing members that act on the photosensitive member may be integrated into a cartridge such that the process cartridge may be attachable and detachable with respect to a body of the image forming apparatus.

Control related to image forming is performed with a control unit 25 including a CPU 26.

(2) Belt Cleaning Device

In the present exemplary embodiment, a hybrid cleaning method described above is employed. A belt cleaning blade 21 serving as an abutting member is disposed on the upstream side of the intermediate transfer belt 8 in the moving direction. The belt cleaning blade 21 scrapes off most of the toner on the intermediate transfer belt 8. Furthermore, a very small amount of passed-through toner is charged with a conductive brush 23 serving as a charging member disposed on the downstream side of the intermediate transfer belt 8 in the moving direction. Details thereof will be described below.

Figure 2:
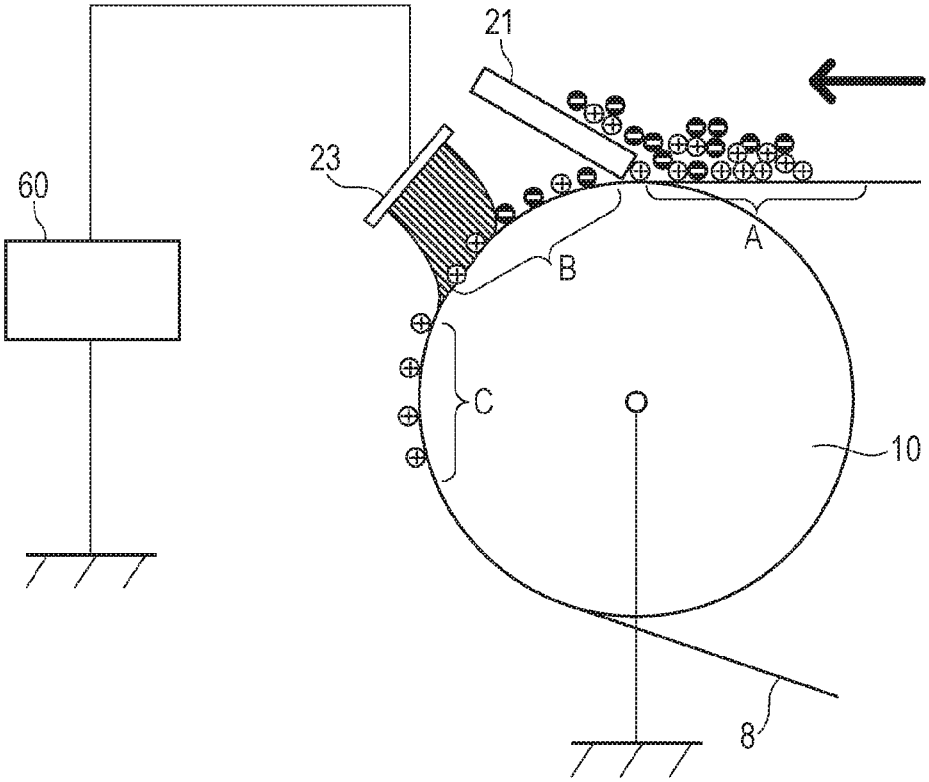
FIG. 2 is a schematic diagram of a vicinity of a belt cleaning device according to an exemplary embodiment of the present disclosure.

FIG. 2 is a schematic diagram illustrating the vicinity of the belt cleaning device 52 according to the present exemplary embodiment in more detail. The belt cleaning device 52 includes, on the upstream side of the intermediate transfer belt 8 in the moving direction, the belt cleaning blade 21 that is a blade-shaped member (the abutting member) that abuts against the intermediate transfer belt 8 and that serves as a cleaning member. Furthermore, the belt cleaning device 52 includes the conductive brush 23 that abuts against the intermediate transfer belt 8 on the downstream side of the intermediate transfer belt 8 in the moving direction with respect to the belt cleaning blade 21 and that serves as the charging member that charges the toner on the intermediate transfer belt 8. The belt cleaning blade 21 and the conductive brush 23 are pressed towards the tension roller 10 with the intermediate transfer belt 8 in between. Furthermore, the belt cleaning blade 21 and the conductive brush 23 are supported by a waste toner container 22.

The belt cleaning blade 21 is a tabular member formed of an elastic material. In the present exemplary embodiment, a tabular member formed of urethane rubber serving as an elastic material is used as the belt cleaning blade 21. More specifically, in the present exemplary embodiment, the belt cleaning blade 21 is a member in which the length in the longitudinal direction is 232 mm, the length in the short direction is 12 mm, and the thickness is 2 mm.

The belt cleaning blade 21 abuts against the intermediate transfer belt 8 in the whole area thereof in the longitudinal direction, which is substantially orthogonal to the moving direction of the intermediate transfer belt 8, such that the free end side thereof in the short direction, which is substantially orthogonal to the longitudinal direction, is oriented upstream in the moving direction of the intermediate transfer belt 8. Furthermore, an edge portion of the free end on the intermediate transfer belt 8 side and/or a surface of a predetermined range from the edge portion towards a fixed end side is in contact with the surface of the intermediate transfer belt 8. In order to obtain a satisfactory cleaning performance and not to apply any damage to the blade and belt with excessive pressure, the linear pressure of the belt cleaning blade 21 is preferably 0.4 to 0.8 N/cm, and more preferably, is 0.55 to 0.67 N/cm.

Herein, the linear pressure of the belt cleaning blade 21 is the contact pressure of the belt cleaning blade 21 applied on the intermediate transfer belt 8 per unit length of the belt cleaning blade 21. The linear pressure can be obtained by pressing the belt cleaning blade 21 against the surface of the intermediate transfer belt 8 and measuring the load with a load converter attached to the intermediate transfer belt 8.

The conductive brush 23 is positioned downstream of the belt cleaning blade 21 with respect to the moving direction of the intermediate transfer belt 8 and is positioned upstream of the first image forming unit PY. Furthermore, the conductive brush 23 is configured so that the distal end thereof is continuously in contact with the intermediate transfer belt 8 while the intermediate transfer belt 8 is moving and charges the passed-through toner. While the disclosure is not limited to the below, in the present exemplary embodiment, the material of the conductive brush 23 is nylon and the conductive brush 23 is configured such that the fineness is 7 decitex, the pile length is 3 mm, the brush width (the width in the moving direction of the intermediate transfer belt 8) is 5 mm, and the electrical resistivity is $1.0\times10^{6}\Omega$. A high-voltage power source 60 serving as a voltage supplying member is connected to the conductive brush 23, and a predetermined voltage is applied to the conductive brush 23 from the high-voltage power source 60 controlled by the control unit 25. The voltage applied to the conductive brush 23 is different based on the material of the conductive brush 23 and the environment (the temperature and the humidity) and the like in which the image forming apparatus 100 is used.

(3) Hybrid Cleaning

A method of cleaning up the toner on the intermediate transfer belt 8 according to the present exemplary embodiment will be described in more detail next.

Most of the residual toner remaining on the intermediate transfer body is mechanically scraped off with the belt cleaning blade 21 disposed on the upstream side in the moving direction of the intermediate transfer belt 8 and is collected in the waste toner container 22 (portion A in FIG. 2).

Meanwhile, there is a minute unevenness on the surface of the intermediate transfer belt 8 caused during manufacturing and by adhesion of foreign matter. Since adhesion between the belt cleaning blade 21 and the intermediate transfer belt 8 is insufficient in the portion where there is a minute unevenness, the passed-through toner that passes through the belt cleaning blade 21 is created easily (portion B in FIG. 2). Furthermore, the polarity of the triboelectric charge of the passed-through toner tends to become negative due to friction between the belt cleaning blade 21 and the intermediate transfer belt 8.

If the passed-through toner is left in the above state, the cleaning becomes faulty; accordingly, the toner is charged with the conductive brush 23 disposed downstream in the moving direction of the intermediate transfer belt 8 and, in the present exemplary embodiment, is collected by reverse transferring the toner to the photosensitive drum 1 at the image forming unit P. The image forming unit that collects the toner is different between when performing in monochrome mode (a second mode) and when performing in full-color mode (a first mode), and the details thereof will be described later.

Note that a roller-shaped member (a conductive roller) may be employed as the charging device that charges the toner on the intermediate transfer belt 8. However, the brush-shaped member (the conductive brush) is more desirable since the brush-shaped member follows the unevenness of the surface of the intermediate transfer belt 8 in a flexible manner.

When passing through the conductive brush 23, the passed-through toner is charged to have a positive polarity, which is a polarity that is opposite to the charge polarity of the toner during development, with the voltage having a positive polarity that has been applied by the high-voltage power source 60. With the above, a positive charge is applied to the passed-through toner that is suitable for achieving electrostatic cleaning (portion C in FIG. 2). The voltage value needed to apply the positive charge suitable for electrostatic cleaning to the passed-through toner in a substantially uniformly manner is set in a range that prevents both the faulty cleaning and the negative ghost from occurring. In the present exemplary embodiment, the value of the voltage that has a positive polarity and that is applied to the conductive brush 23 is desirably set to +1.25 (a first value) kV or more to +1.75 (a second value) kV. As a feature of the present disclosure, the suitable voltage value for monochrome mode and that for full-color mode are different; accordingly, details thereof will be described in detail later.

(4) Monochrome Image Forming Operation

Other than full-color mode (the first mode) described later, the control unit 25 is capable of executing monochrome mode (the second mode) that forms a monochromatic toner image. Hereinafter, an image forming operation in monochrome mode with the image forming apparatus 100 of the present exemplary embodiment will be described first.

Note that in the present exemplary embodiment, monochrome mode in which a monochromatic black image, which is most frequently used, is formed will be described as an example. The image forming unit PK used in monochrome mode is disposed most downstream in the moving direction of the intermediate transfer belt 8. In monochrome mode, only the photosensitive drum 1K alone (only a single image carrying member) is used in the image forming operation.

When a start signal of an image forming operation in monochrome mode (black color alone) is issued, the developing rollers 41Y to 41C of the developing devices 7Y to 7C of the first to third image forming units PY to PC are separated from the photosensitive drums 1Y to 1C, respectively. By not rotationally driving the developing rollers 41Y to 41C that have been separated from the photosensitive drums 1Y to 1C, deterioration and exhaustion of the toners having the colors corresponding to the developing rollers 41Y to 41C can be prevented. With the above, shortening of the lifetime of the image forming unit can be prevented.

Furthermore, each of the first to fourth image forming units PY to PK are rotationally driven at a processing speed of 210 mm/sec. Furthermore, each of the rotating photosensitive drums 1Y to 1K is uniformly charged with the corresponding charge rollers 2Y to 2K. Specifically, in the present exemplary embodiment, the surface of each of the photosensitive drums 1Y to 1K is uniformly charged to about −500 V.

In the first to third image forming units PY to PC, only the operations of the photosensitive drums 1Y to 1C and those of the charge rollers 2Y to 2C described above are performed and other image forming operations are not performed.

Meanwhile, image formation is performed in the fourth image forming unit PK in the following manner. An electrostatic latent image is formed on the surface of the photosensitive drum 1K on the basis of information of the black-colored image, and the electrostatic latent image is developed as a black-colored toner image with the developing device 7K. In other words, the toner that is carried on the developing roller 41K of the developing device 7K and that forms a thin layer thereon is transported to a portion (the developing portion) where the photosensitive drum 1K and the developing roller 41K oppose each other upon rotation of the developing roller 41K. Furthermore, a development voltage that has the same polarity to the charge polarity of the photosensitive drum 1K (a negative polarity in the present exemplary embodiment) is applied to the developing roller 41K. With the above, the black-colored toner on the developing roller 41K is electrostatically absorbed onto the surface of the photosensitive drum 1K according to the charge potential of the surface of the photosensitive drum 1K and the electrostatic latent image on the photosensitive drum 1K is developed as a toner image.

The black-colored toner image formed on the photosensitive drum 1K in the above manner is, at the primary transfer portion N1K of the fourth image forming unit PK, transferred (primary transferred) onto the intermediate transfer belt 8 that is moving at a processing speed of 210 mm/sec. In the above, a voltage of +600 V that has a polarity (a positive polarity in the present exemplary embodiment) that is opposite the normal charging polarity of the toner is applied as a primary transfer voltage to the primary transfer roller 5*k* through the core metal when in an environment in which the temperature is 23° C. and the humidity is 50% Rh (hereinafter, referred to as an "N/N environment"). With the application of the primary transfer voltage, an electric field that moves the toner that has been charged to have a normal charging polarity (a negative polarity in the present exemplary embodiment) to be moved in the direction extending from the photosensitive drum 1K to the intermediate transfer belt 8 is formed in the primary transfer portion N1K.

Furthermore, the operation of the primary transfer rollers 5Y to 5C of the first to third image forming units PY to PC in the above case will be described later.

Subsequently, a transfer material S is transported to the secondary transfer portion N2 with the registration roller 16 at a timing that matches the timing in which the front end of the black-colored toner image on the intermediate transfer belt 8 is moved to the secondary transfer portion N2. The black-colored toner image on the intermediate transfer belt 8 is transferred (secondarily transferred) to the transfer material S. In the above, a predetermined voltage having a polarity (a positive polarity in the present exemplary embodiment) that is opposite the normal charging polarity of the toner is applied to the secondary transfer roller 11 as a secondary transfer voltage. After the above, the transfer material S on which a monochrome (black) toner image has been formed is transported to the fixing device 17. After the unfixed monochrome toner image is heat fixed to the surface by being heated and compressed at the fixing nip portion between the fixing roller 18 and the pressure roller 19 that are provided in the fixing device 17, the transfer material S is discharged to the outside of the image forming apparatus 100. The monochrome (black) image is output in the above manner.

The residual primary transfer toner remaining on the photosensitive drum 1K after the primary transfer has been performed is removed and collected by the drum cleaning device 6K.

Furthermore, the residual secondary transfer toner remaining on the intermediate transfer belt 8 after the secondary transfer has been performed is collected by the belt cleaning device 52 in the following manner.

In the present exemplary embodiment, the collection of the passed-through toner in monochrome mode is mainly performed by the fourth image forming unit PK that is forming the image in monochrome mode. The reason for the above is as follows. That is, the fourth image forming unit PK is the image forming unit that becomes deteriorated and exhausted in monochrome mode and the other image forming units PY to PC hardly become deteriorated or exhausted. Accordingly, by using the collected toner container 62 of the fourth image forming unit PK as the collected toner container that collects the passed-through toner in monochrome mode, reduction of the lifetime of each of the first to third image forming units PY to PC that do not form any image can be prevented.

In order to achieve collection of the passed-through toner in the above manner by reverse transferring the passed-through toner to the photosensitive drum 1K at the primary transfer portion N1K of the fourth image forming unit PK, the first to third image forming units PY to PC operate in the following manner. That is, at the primary transfer portions N1Y to N1C of the first to third image forming units PY to PC, the primary transfer rollers 5Y to 5C are charged with a voltage having a negative polarity that is the same polarity as the normal charging polarity of the toner. Specifically, the control unit 25 applies a voltage of −700 V to the primary transfer rollers 5Y to 5C of the first to third image forming units PY to PC through the core metals of the primary transfer rollers 5Y to 5C.

With the above, in the first to third image forming units PY to PC, a potential difference (a potential difference equivalent to or under the discharge threshold) of 200 V can be provided in each of the photosensitive drums 1Y to 1C that has been charged to about −500 V. Accordingly, the passed-through toner that has been charged to have a positive polarity after passing through the conductive brush 23 is held on the intermediate transfer belt 8 without being collected by the photosensitive drums 1Y to 1C at the primary transfer portions N1Y to N1C of the first to third image forming units PY to PC. Then, the passed-through toner is transported, as it is, to the primary transfer portion N1K of the fourth image forming unit PK. In the above, the voltage described above is applied to the primary transfer portions N1Y to N1C such that electric fields moving the passed-through toner, which is charged to have a positive polarity, in the direction extending from the photosensitive drums 1Y to 1C towards the intermediate transfer belt 8 are formed.

Note that the voltage applied to the primary transfer rollers 5Y to 5C can be small since the amount of toner (the amount of past-through toner) passing through the conductive brush 23 is small. If, supposedly, a cleaning device in which the belt cleaning blade 21 has been dismounted is employed, the amount of toner passing through the conductive brush 23 becomes large. Accordingly, in order to hold the toner on the intermediate transfer belt 8, −700 V is insufficient as the absolute value of the voltage having a negative polarity applied to the primary transfer rollers 5Y to 5C and about −1000 V is required.

Furthermore, while the black-colored toner image is primarily transferred from the photosensitive drum 1K to the intermediate transfer belt 8 at the primary transfer portion N1K of the fourth image forming unit PK, the passed-through toner is reverse transferred to the photosensitive drum 1K and is collected. In the above, a primary transfer voltage of +600 V is applied to the primary transfer roller 5K of the fourth image forming unit PK through the core metal of the primary transfer roller 5K. In other words, in the above, with the application of the primary transfer voltage, an electric field moving the toner, which is charged to have a negative polarity, in the direction extending from the photosensitive drum 1K towards the intermediate transfer belt 8 is formed at the primary transfer portion N1K. At the same time, with the application of the primary transfer voltage, an electric field moving the passed-through toner, which is charged to have a positive polarity, in the direction extending from the intermediate transfer belt 8 towards the photosensitive drum 1K is formed at the primary transfer portion N1K (collection at transfer).

The passed-through toner that has been reverse transferred onto the photosensitive drum 1K of the fourth image forming unit PK and that has been conveyed together with the residual primary transfer toner on the photosensitive drum 1K is removed and collected by the drum cleaning device 6K.

In order to prevent faulty cleaning and negative ghost described above from occurring, in the present exemplary embodiment, when under the N/N environment, a constant voltage of +1.75 kV is applied to the conductive brush 23 of the belt cleaning device 52 during monochrome mode. As a result, an electric current of +70 μA flows in the conductive brush 23.

With the application of the toner charging voltage, the passed-through toner on the intermediate transfer belt 8 is charged through the discharge of the conductive brush 23 and is uniformly charged.

Specifically, with the application of the toner charging voltage, the passed-through toner on the intermediate transfer belt 8 is charged to about +30 μC/g after passing through the conductive brush 23. The passed-through toner that has been charged to about +30 μC/g is, as described above, held on the intermediate transfer belt 8 without being collected by the photosensitive drums 1Y to 1C at the primary transfer portions N1Y to N1C of the first to third image forming units PY to PC. Then, the passed-through toner is transported, as it is, to the primary transfer portion N1K of the fourth image forming unit PK.

As described above, in the first to third image forming units PY to PC, the potential difference between each of the primary transfer rollers 5Y to 5C and the corresponding one of the photosensitive drums 1Y to 1C is 200 V and is smaller than the discharge threshold voltage. Accordingly, the passed-through toner is transported without any change in the value of the triboelectricity from immediately after the charge to immediately before the primary transfer portion N1K of the fourth image forming unit PK. Specifically, the value of the triboelectricity of the passed-through toner is, without any change, +30 μC/g even after passing through the primary transfer portions N1Y to N1C of the first to third image forming units PY to PC. Accordingly, since the potential differences between the primary transfer rollers 5Y to 5C and the photosensitive drums 1Y to 1C can be maintained at 200 V, increase in the triboelectricity of the toner after passing through the primary transfer portions N1Y to N1C of the first to third image forming units PY to PC is suppressed.

(5) Full-Color Image Forming Operation

An image forming operation in full-color mode with the image forming apparatus 100 of the present exemplary embodiment will be described next.

Similar to the monochrome mode, first, an image is formed in the first image forming unit PY. Since the process until the primary transfer is performed is similar to the monochrome mode, description thereof will be omitted. Subsequently, transfer (primary transfer) of the toner images of the colors magenta, cyan, and black is performed in the second, third, and fourth image forming units PM, PC, and PK as well in a similar manner as above. In other words, the toner images of the colors magenta, cyan, black that are formed on the photosensitive drums IM, 1C, and 1K are sequentially superposed on the yellow toner image, which has been transferred on the intermediate belt 8, and are transferred (primarily transferred) at the primary transfer portions N1M, N1C, and N1K. With the above, a full-colored toner image is formed on the intermediate transfer belt 8.

Then, similar to the monochrome mode, secondary transfer, fixation, discharge are performed and a full-color image is output. The residual primary transfer toner remaining on each of the photosensitive drums 1Y to 1K after the primary transfer has been performed is removed and collected by the drum cleaning devices 6Y to 6K.

The residual secondary transfer toner remaining on the intermediate transfer belt 8 after the secondary transfer has been performed is collected by the belt cleaning device 52 in the following manner. As described above, most of the residual secondary transfer toner is mechanically scraped off by the belt cleaning blade 21. A portion of the passed-through toner is charged to ah e a positive polarity with the conductive brush 23 and is collected with the image forming units P.

In the present exemplary embodiment, collection of the passed-through toner in full-color mode is mainly performed by the first image forming unit PY. However, the passed-though toner that had not been able to be collected by the image forming unit PY is collected by the second and third image forming units PM and PC. The collection ratio is as follows: image forming unit PY:image forming unit PM:image forming unit PC=about 9.0:about 0.7:about 0.3. As described above, the amount of the passed-through toner is minute and since the ratio thereof against the volume of the drum cleaning devices 6 are negligible, no problem will occur even if the collection ratio is different from that of the above.

Similar to the monochrome mode described above, a constant voltage is applied to the conductive brush 23 of the belt cleaning device 52. However, in full-color mode, a voltage of +1.25 kV is applied when under the N/N environment. With the application of the toner charging voltage, when under the N/N environment, an electric current of about +30 μA flows in the conductive brush 23 and the passed-through toner is charged to about +21 μC/g after passing through the conductive brush 23.

As a feature of the present disclosure, the absolute value of the voltage supplied by the high-voltage power source 60 to the conductive brush 23 in full-color mode (+1.25 kV) is smaller than that in monochrome mode (+1.75 kV). In other words, the absolute value of the charging current flowing in the conductive brush 23, owing to the high-voltage power source 60 supplying voltage to the conductive brush 23, is smaller in full-color mode (+30 μA) than that in monochrome mode (+70 μA). As a result, the triboelectricity of the charged passed-through toner is smaller in full-color mode (+21 μC/g) than that in monochrome mode (+30 μC/g).

The reason why, in full-color mode, the electric current value distributed to the conductive brush 23 can be smaller and no faulty cleaning occurs even if the triboelectricity of the charged passed-through toner is +21 μC/g is that the number of image forming units that collect the charged passed-through toner is larger than that in monochrome mode. Specifically, as described above, in full-color mode, three image forming units, namely, the image forming units PY, the image forming units PM, and the image forming units PC, collect the charged passed-through toner. As a result, compared with monochrome mode in which the image forming unit that performs collection is the image forming unit PK alone, there are more opportunities of the charged passed-through toner to be collected by the photosensitive drums 1; accordingly, even if the triboelectricity of the charged passed-through toner is +21 μC/g, substantially all of the passed-though toner can be collected.

Regarding faulty cleaning, no problem is caused even when the value of the electric current distributed to the conductive brush 23 is larger than +30 μA and the value of the triboelectricity after charging is larger than +21 μC/g. Specifically, even when at +30 μC/g (applying 1.75 kV and distributing 70 μA to the conductive brush 23) that is the same as that in monochrome mode, no negative ghost is generated and no problem occurs.

Meanwhile, in order to increase the lifetime of the full-color mode, deterioration in the current carrying capacity of the conductive brush 23 needs to be suppressed; accordingly, it is desirable that electric current distributed to the conductive brush 23 is small to the extent possible. Accordingly, while balancing faulty cleaning and increase in lifetime, a voltage of +1.25 kV is applied and an electric current of +30 μA is distributed to the conductive brush 23 such that the triboelectricity of the charged passed-through toner is +21 μC/g.

Subsequently, the charged passed-through toner is transported to the primary transfer portion N1Y of the first image forming unit PY. After the above, similar to the monochrome mode, collection at transfer is performed in the primary transfer portion N1Y of the first image forming unit PY.

The passed-though toner that had not been able to be collected is collected by the second and third image forming units PM and PC in a manner similar to that of the image forming unit PY described above.

(6) Result of Image Output Experiment of Present Exemplary Embodiment

A result of an image output experiment of the present exemplary embodiment will be described next. The processing speed of the image forming apparatus used in the experiment was 210 mm/sec and the throughput thereof was 40 sheets in one minute. Furthermore, the atmospheric environment in which the experiment was conducted was an N/N environment in which the temperature was 23° C. and the humidity was 50%.

For the transfer material S, LTR sized "25% COTTON CONTENT" (product name) with a basis weight of 75 g/m$^2$ was used. The evaluated images were seven sets of 20 sheets, each set being an alternation of two sheets of black and monochrome solid images (images with maximum density) and two sheets of white solid images (images with minimum density, that is, a non-image portion) and having different voltages applied to the conductive brush 23 in seven levels described later. The image formation mode that was employed was a rough paper (rough surfaced paper) mode.

The transfer material S that was used in the experiment was a so-called rough paper, and since the secondary transfer efficiency decreases and the amount of residual secondary transfer toner increases, it was an unfavorable condition for cleaning.

Using sampled evaluation images, the degree of "(1) faulty cleaning" and the degree of "(2) negative ghost" of the output images were observed and ranked. In the ranking, A indicated that there were no occurrence of an image defect, B indicated that a minor image defect was identified, C indicated that an apparent image defect was identified, D indicated that the level of the image defect was bad, and E indicated that the level of the image defect was very bad.

Furthermore, an evaluation of "(3) page number at end of lifetime" was performed. Specifically, the page number at the end of lifetime was defined as the maximum number of printable pages before faulty cleaning caused by deterioration in the current carrying capacity occurs.

The voltage applied to the conductive brush 23 was changed by an increment of 0.25 kV from +0.75 kV to +2.25 kV.

In order to observe the state of the triboelectricity of the passed-through toner in each condition, separate to the image output, the triboelectricity of the toner at immediately before the primary transfer portion N1 of the image forming unit where the passed-through toner is collected was measured by forcibly stopping the image forming apparatus during the image forming operation that was performed with the same conditions. In a similar manner, the triboelectricity of the passed-through toner that has passed through the conductive brush 23 and that has not yet reached the primary transfer portion N1Y of the first image forming unit PY was measured. As the triboelectricity of the toner, a value defined in units of μC/g was calculated from the value of the weight and charge amount of the toner on the intermediate transfer belt 8 that had been suctioned and sampled, which had been measured by an electronic balance and a Faraday gauge.

The evaluation result is shown in Table 1.

TABLE 1

| | | | | | | | | |
|---|---|---|---|---|---|---|---|---|
| Full-Color Mode | Brush Voltage (kV) | 0.75 | 1 | 1.25 | 1.5 | 1.75 | 2 | 2.25 |
| | Brush Current (μA) | 10 | 20 | 30 | 50 | 70 | 100 | 150 |
| | Faulty Cleaning | E | C | A | A | A | A | A |
| | Negative Ghost | A | A | A | A | A | C | E |
| | Triboelecticity Immediately after Charging (μC/g) | 10 | 16 | 21 | 26 | 30 | 35 | 40 |
| | Triboelecticity before Collection (μC/g) | 10 | 16 | 21 | 26 | 30 | 35 | 40 |
| | Page Number at End of Lifetime (K) | 250 | 225 | 200 | 175 | 150 | 125 | 100 |
| Monochrome Mode | Brush Voltage (kV) | 0.75 | 1 | 1.25 | 1.5 | 1.75 | 2 | 2.25 |
| | Brush Current (μA) | 10 | 20 | 30 | 50 | 70 | 100 | 150 |
| | Faulty Cleaning | E | E | D | B | A | A | A |
| | Negative Ghost | A | A | A | A | A | C | E |
| | Triboelecticity Immediately after Charging (μC/g) | 10 | 16 | 21 | 26 | 30 | 35 | 40 |
| | Triboelecticity before Collection (μC/g) | 10 | 16 | 21 | 26 | 30 | 35 | 40 |
| | Page Number at End of Lifetime (K) | 250 | 225 | 200 | 175 | 150 | 125 | 100 |

In the present exemplary embodiment, the voltage applied to the conductive brush 23 in monochrome mode is +1.75 kV, the electric current flowing therethrough is +70 μA, and the voltage in full-color mode is +1.25 kV and the electric current is +30 μA. With the above, it has been found that a voltage/electric current conditions that prevent both the faulty cleaning and the negative ghost from occurring and that achieve increase in lifetime during full-color mode can be selected. Specifically, in monochrome mode, the end of the lifetime was 150 K pages, and the end of the lifetime in full-color mode was 200 K pages, thus an increase of 50 K in lifetime was achieved.

Meanwhile, when the same voltage/electric current were set to the conductive brush 23 for the monochrome mode and the full-color mode, the following shortcomings occurred. For example, in the case of +1.25 kV/+30 μA, while no image defect occurred in full-color mode, a faulty cleaning (D) of a bad level occurred in monochrome mode.

Furthermore, in the case of +1.5 kV/+50 μA, the page number at the end of lifetime was reduced to 175 K pages in full-color mode and a faulty cleaning (B) in which a minor defect was identified occurred in monochrome mode. Furthermore, when a voltage of +1.75 kV was applied, while no image defect occurred in monochrome mode, the page number at the end of lifetime was reduced to 150 K pages. As described above, it has been found that when the conductive brush 23 is set with the same voltage/electric current in monochrome mode and in full-color mode, a voltage condition in which no faulty cleaning occurs and in which an increase in the lifetime in full-color mode is achieved cannot be selected.

(7) Summary

As described above, in the present exemplary embodiment, the belt cleaning device 52 employs the belt cleaning blade 21 and the conductive brush 23. Furthermore, the absolute value of the electric current distributed to the conductive brush 23 when the full-color mode is selected is smaller than that when the monochrome mode is selected. With the above, deterioration in the current carrying capacity of the conductive brush 23 can be suppressed and the lifetime in full-color mode can be increased.

Second Exemplary Embodiment

Another exemplary embodiment of the present disclosure will be described next. Configuration and operation of an image forming apparatus of the present exemplary embodiment are the same as those of the first exemplary embodiment. Accordingly, elements that have the same or corresponding functions and configuration as those of the first exemplary embodiment will be attached with the same reference numerals and detailed description thereof will be omitted.

In the present exemplary embodiment, the photosensitive drums 1 of the image forming units that do not form an image are separated from the intermediate transfer belt 8 in monochrome mode. The above is more desirable since, compared with the first exemplary embodiment, the lifetime of the image forming units that do not form an image can be further suppressed from becoming short.

Figure 3A:
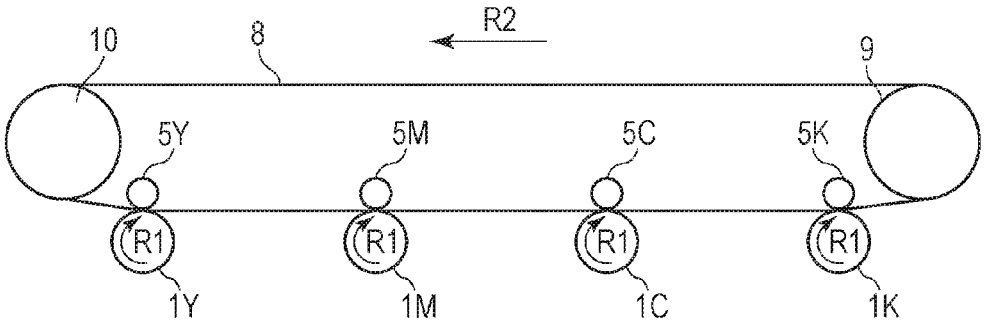
FIG. 3A is a schematic diagram of a vicinity of a primary transfer portion when in full-color mode according to an exemplary embodiment of the present disclosure.

In the present exemplary embodiment, the general formation and the operation in full-color mode are the same as those of the first exemplary embodiment. As illustrated in FIG. 3A, in all of the image forming units, the photosensitive drums 1 and the primary transfer rollers 5 abut against each other with the intermediate transfer belt 8 in between.

Furthermore, similar to the first exemplary embodiment, in full-color mode, a voltage of +1.25 kV is applied when under the N/N environment. With the application of the above toner charging voltage, when under the N/N environment, an electrical current of about +30 μA flows in the conductive brush 23. As a result, the triboelectricity of the charged passed-through toner becomes about +21 μC/g.

The operation of the photosensitive drums 1 of the image forming units that do not form an image being separated from the intermediate transfer belt 8 when in monochrome mode, which is a feature of the present exemplary embodiment, will be described. When a start signal of an image forming operation in monochrome mode (black color alone) is issued, the developing rollers 41Y to 41C of the developing devices 7Y to 7C of the first to third image forming units PY to PC are separated from the photosensitive drums 1Y to 1C, respectively. By not rotationally driving the developing rollers 41Y to 41C that have been separated from the photosensitive drums 1Y to 1C, deterioration and exhaustion of the toners having the colors corresponding to the developing rollers 41Y to 41C can be prevented. With the above, shortening of the lifetime of the image forming unit can be prevented.

Figure 3B:
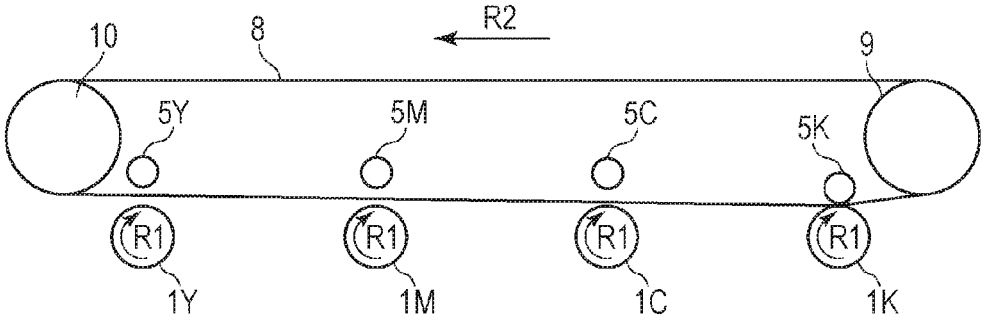
FIG. 3B is a schematic diagram of a vicinity of the primary transfer portion when in monochrome mode according to the exemplary embodiment of the present disclosure.

At the same time, the photosensitive drums 1Y to 1C of the first to third image forming units PY to PC are separated from the intermediate transfer belt 8 and are held without being rotationally driven and primary charged. With the above, deterioration and exhaustion of the photosensitive drums associated with the colors that do not form an image during monochrome mode can be prevented and shortening of the lifetime of the image forming units can be prevented. A drawing of the separated state is illustrated in FIG. 3B. In the present exemplary embodiment, the intermediate transfer belt 8 is separated from the photosensitive drums 1Y to 1C upon retreat of the primary transfer rollers 5Y to 5C. However, not limited to the above, the photosensitive drums 1Y to 1C may be configured to retreat, for example.

Since the image forming operation (charging, latent image formation, developing, primary transferring, secondary transferring, and fixation) in the fourth image forming unit PK is the same as the image forming operation of the first exemplary embodiment in monochrome mode, description thereof is omitted. The residual primary transfer toner remaining on the photosensitive drum 1K after the primary transfer has been performed is removed and collected by the drum cleaning device 6K.

Furthermore, most of the residual secondary transfer toner remaining on the intermediate transfer belt 8 after the secondary transfer has been performed is scraped off with the belt cleaning blade 21, and a portion of the passed-through toner is collected in the following manner. Collection of the passed-through toner in monochrome mode is mainly performed by the fourth image forming unit PK that is forming the image in monochrome mode. In the present exemplary embodiment, as described above, since the photosensitive drums 1Y to 1C of the first to third image forming units PY to PC are separated from the intermediate transfer belt 8, the passed-through toner on the intermediate transfer belt 8 is never collected by the first to third image forming units PY to PC. When the passed-through toner passes through the first to third image forming units PY to PC, no voltage is applied to the photosensitive drums 1Y to 1C and the primary transfer rollers 5Y to 5C. Furthermore, similar to the monochrome mode in the first exemplary embodiment, collection at transfer is performed to the passed-through toner in the primary transfer portion N1K of the fourth image forming unit PK.

Similar to the first exemplary embodiment, the voltage applied to the conductive brush 23 in monochrome mode is +1.75 kV, the electric current flowing therethrough is +70 μA, and the voltage in full-color mode is +1.25 kV and the electric current is +30 μA. With the above, it has been found that a voltage/electric current conditions that prevent both the faulty cleaning and the negative ghost from occurring and that achieve increase in lifetime during full-color mode can be selected. Specifically, in monochrome mode, the end of the lifetime was 150 K pages, and the end of the lifetime in full-color mode was 200 K pages, thus an increase of 50 K in lifetime was achieved.

Accordingly, in the present exemplary embodiment as well, similar to the first exemplary embodiment, the absolute value of the charging current flowing in the conductive brush 23, owing to the high-voltage power source 60 supplying voltage to the conductive brush 23, is smaller in full-color mode than that in monochrome mode.

As described above, in the present exemplary embodiment, while suppressing deterioration in the current carrying capacity of the conductive brush 23, the photosensitive drums 1 of the image forming units that do not form an image are separated from the intermediate transfer belt 8 in monochrome mode so that the reduction in the lifetime of the image forming unit that is not used can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-062573, filed Mar. 25, 2015, which is hereby incorporated by reference herein in its entirety.

What is claimed is:

1. An image forming apparatus comprising:

a plurality of image carrying members that each carry a toner image;

an intermediate transfer body that is capable of moving while abutting against the image carrying members, the toner image of each image carrying member being primarily transferred onto the intermediate transfer body;

a cleaning member that includes an abutting member that scrapes off residual toner that remains on the intermediate transfer body without being secondary transferred to a transfer material from the intermediate transfer body, and a charging member that is positioned downstream of the abutting member in a moving direction of the intermediate transfer body and that charges the residual toner that has passed through the abutting member; and a control unit that is capable of executing a first mode in which a toner image is primary transferred from each of the plurality of image carrying members to the intermediate transfer body, and a second mode in which a toner image is primary transferred from a single image carrying member among the plurality of image carrying members to the intermediate transfer body, wherein the control unit controls a value of a charging current that is generated when charging the residual toner with the charging member such that the value when the first mode is executed is smaller than the value when the second mode is executed.

2. The image forming apparatus according to claim 1, wherein while the residual toner charged by the cleaning member is moved from the intermediate transfer body to one or more of the image carrying members, one or more of the toner images are primary transferred from the one or more of the image carrying members to the intermediate transfer body.

3. The image forming apparatus according to claim 1, wherein the plurality of image carrying member each carry a toner image of a different color.

4. The image forming apparatus according to claim 1, wherein the single image carrying member in the second mode is an image carrying member that is disposed most downstream in the moving direction of the intermediate transfer body.

5. The image forming apparatus according to claim 1, wherein in the second mode, the image carrying members other than the single image carrying member abut against the intermediate transfer body.

6. The image forming apparatus according to claim 5, wherein a potential difference generated between each image carrying member and the intermediate transfer body is equivalent to or below a discharge threshold.

7. The image forming apparatus according to claim 6, further comprising a high-voltage power source that applies a charge voltage to the charging member, the high-voltage power source applying a voltage that has a positive polarity and that ranges from a first value to a second value to the charging member.

8. The image forming apparatus according to claim 7, wherein the first value is a value of a voltage that the high-voltage power source applies to the charging member when the first mode is executed, and the second value is a value of a voltage that the high-voltage power source applies to the charging member when the second mode is executed.

9. The image forming apparatus according to claim 1, wherein in the second mode, the image carrying member other than the single image carrying member is separated from the intermediate transfer body.

10. The image forming apparatus according to claim 1, wherein the abutting member is a cleaning blade formed of rubber.

11. The image forming apparatus according to claim 1, wherein the charging member is a conductive brush in which a distal end thereof is continuously in contact with the intermediate transfer body while the intermediate transfer body is moving.

* * * * *